US007536987B2

(12) United States Patent
Yoshijima et al.

(10) Patent No.: US 7,536,987 B2
(45) Date of Patent: May 26, 2009

(54) MOUNTING STRUCTURE OF FUNCTIONAL DEVICE FOR INTERNAL COMBUSTION ENGINE

(75) Inventors: Kazuya Yoshijima, Okazaki (JP); Akihiro Osaki, Okazaki (JP); Junichi Shimokata, Aichi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 196 days.

(21) Appl. No.: 11/794,140

(22) PCT Filed: Jan. 6, 2006

(86) PCT No.: PCT/JP2006/300046

§ 371 (c)(1),
(2), (4) Date: Jun. 26, 2007

(87) PCT Pub. No.: WO2006/073161

PCT Pub. Date: Jul. 13, 2006

(65) Prior Publication Data

US 2008/0060595 A1 Mar. 13, 2008

(30) Foreign Application Priority Data

Jan. 7, 2005 (JP) ..... 2005-002807

(51) Int. Cl.
*F01M 1/06* (2006.01)

(52) U.S. Cl. ..... 123/90.33; 123/90.15; 123/90.17; 123/90.16; 123/90.31

(58) Field of Classification Search ..... 123/90.15, 123/90.16, 90.17, 90.31, 90.33
See application file for complete search history.

(56) References Cited

U.S. PATENT DOCUMENTS 6,640,757 B2 * 11/2003 Uchida ..... 123/90.12
2004/0025819 A1 2/2004 Itou

FOREIGN PATENT DOCUMENTS

| | | |
|---|---|---|
| JP | 02-24002 | 2/1990 |
| JP | 09-236002 | 9/1997 |
| JP | 2003-035179 A | 2/2003 |
| JP | 2003-035199 | 2/2003 |
| WO | WO 02/46583 A1 | 6/2002 |

* cited by examiner

*Primary Examiner*—Zelalem Eshete
(74) *Attorney, Agent, or Firm*—Kenyon & Kenyon LLP

(57) ABSTRACT

A stay for keeping an oil control valve fastened to a sleeve extends across the outer surface of a head cover from the oil control valve and is fixed by a screw. Thus, the OCV is removable from the sleeve without dismounting the head cover from the cylinder head by loosening the screw from the outside of the head cover and detaching the stay.

20 Claims, 13 Drawing Sheets

MOUNTING STRUCTURE OF FUNCTIONAL DEVICE FOR INTERNAL COMBUSTION ENGINE

This is a 371 national phase application of PCT/JP2006/300046 filed Jan. 6, 2006, claiming priority to Japanese Patent Application No. 2005-002807 filed Jan. 7, 2005, the contents of which are incorporated herein by reference.

FIELD OF THE INVENTION

The present invention relates to a mounting structure for a functional device for an internal combustion engine such as an oil control valve.

BACKGROUND OF THE INVENTION

When an oil control valve, which performs hydraulic oil pressure supply and discharge control for a variable valve mechanism in an internal combustion engine, is incorporated in the cylinder head, the oil control valve may be mounted on a head cover to facilitate the attachment and detachment of the oil control valve. In this case, if the head cover has a dimensional error or if the head cover is deformed when attached to the cylinder head, displacement between the oil control valve and a hydraulic oil supply-discharge passage of the cylinder head may cause the oil seal to deteriorate.

To prevent such deterioration in the oil seal, a structure for attaching an oil control valve to a cam cap and exposing a connector, which is electrically connected to a solenoid of the oil control valve, through a hole extending through the head cover has been proposed (refer to, for example, patent document 1).

An attachment leg for fixing the oil control valve to the cam cap is fixed to the cam cap in the structure of patent document 1. Thus, when replacing the oil control valve, the attachment leg must be loosened after removing the head cover. Such replacement work is complicated.

There is a demand for easier replacement of not only the oil control valve but also other functional devices for an internal combustion engine such as sensor.

Patent Document 1: International Publication No. WO2002/046583

SUMMARY OF THE INVENTION

It is an object of the present invention to facilitate the replacement of a functional device in an internal combustion engine.

To achieve the above object, the present invention provides a mounting structure for a functional device for an internal combustion engine. The functional device is connected to or faces toward an internal mechanism of the internal combustion engine arranged in the vicinity of a cylinder head in a state covered by a head cover. The functional device is partially exposed from the head cover through an opening in the head cover. The mounting structure includes an attachment portion for attachment of the functional device. The functional device when attached to the attachment portion is detachable from the attachment portion through the opening. A base is integrated with the attachment portion. The base is fixed to the cylinder head in order to position the attachment portion relative to the cylinder head. A seal member oil-seals a gap between the circumference of the opening and a circumferential surface of the attachment portion or a gap between the circumference of the opening and a circumferential surface of the functional device. A stay extends across the functional device and an outer surface of the head cover to keep the functional device fastened to the attachment portion.

DETAILED DESCRIPTION OF THE PREFERRED EMBODIMENTS

A first embodiment of the present invention will now be described.

Figure 1:
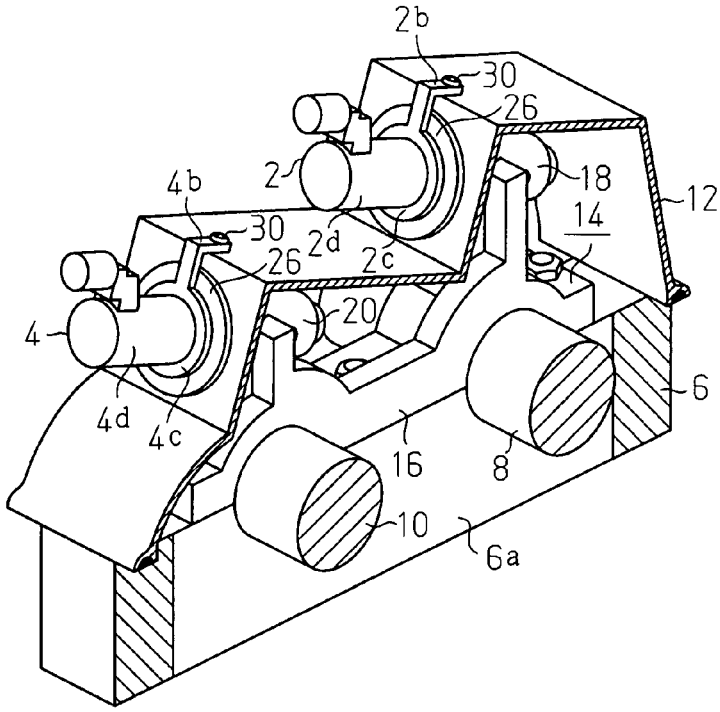
FIG. 1 is a perspective view showing an oil control valve (OCV) mounting structure according to a first embodiment of the present invention.
Figure 2:
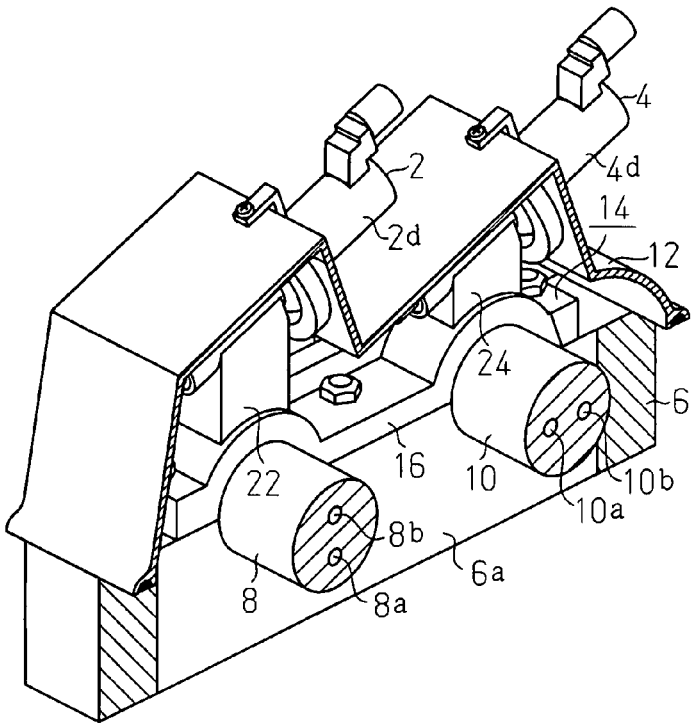
FIG. 2 is a perspective view showing the OCV mounting structure of FIG. 1.

FIGS. 1 to 5 show a mounting structure for oil control valves (OCV) 2 and 4, which serve as internal combustion engine functional devices in an internal combustion engine. FIGS. 1 and 2 are perspective views taken from viewpoints that are separated from each other by 180° C. about a vertical axis. In FIGS. 1 and 2, a cylinder head 6 together with an intake camshaft 8, an exhaust camshaft 10, and a head cover 12, which are arranged on the cylinder head 6, are shown cut along a cross-section perpendicular to the axes of the camshafts 8 and 10.

As shown in FIGS. 1 to 5, the intake camshaft 8 and the exhaust camshaft 10 are supported by a cam journal 6*a* so as to be rotatable between the cam journal 6*a* and a cam cap assembly 14.

Figure 6:
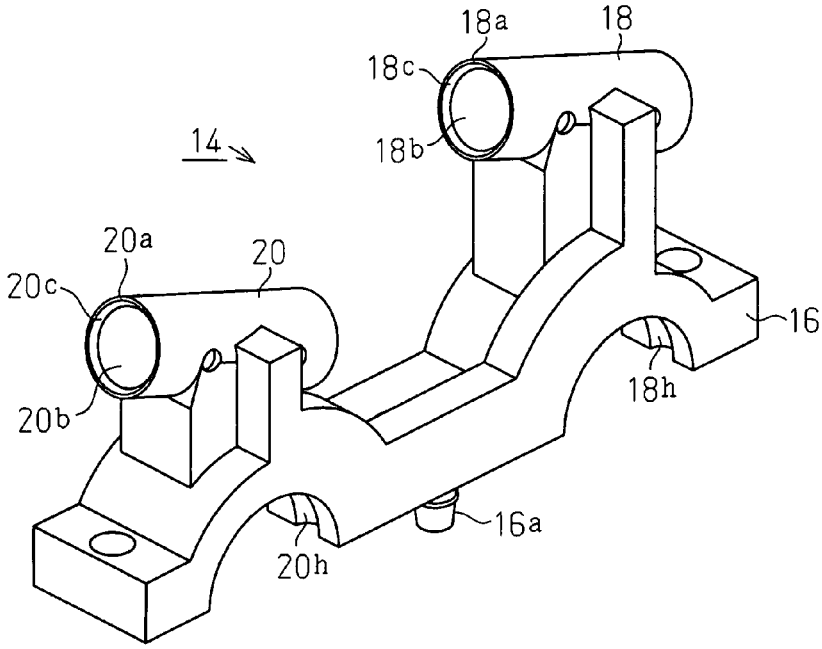
FIG. 6 is a perspective view showing a cap assembly from above in the OCV mounting structure of FIG. 1.
Figure 7:
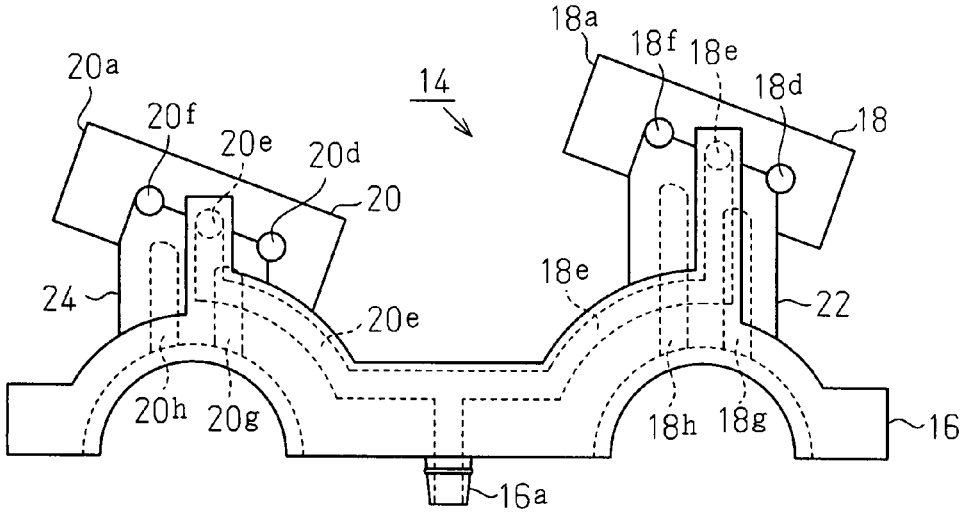
FIG. 7 is a front view showing the cam cap assembly of FIG. 6.
Figure 8:
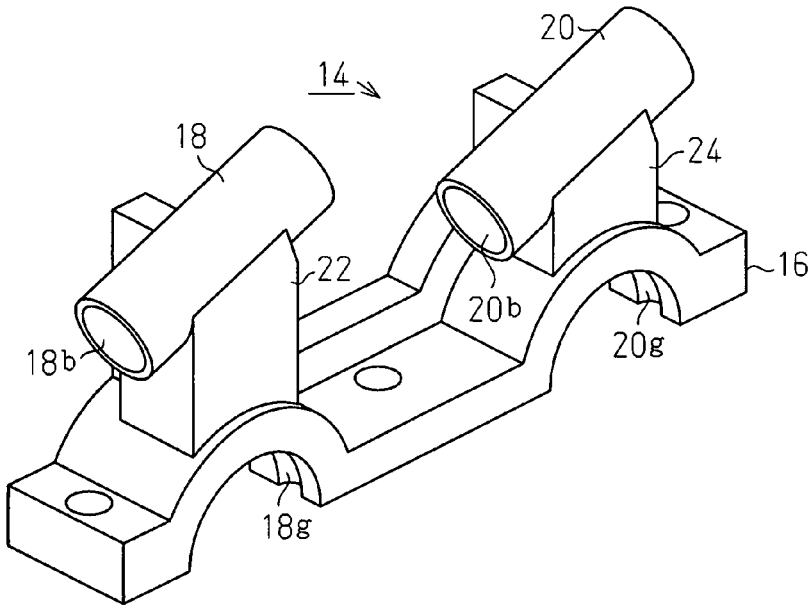
FIG. 8 is a perspective view showing the cam cap assembly of FIG. 6 from above.
Figure 9:
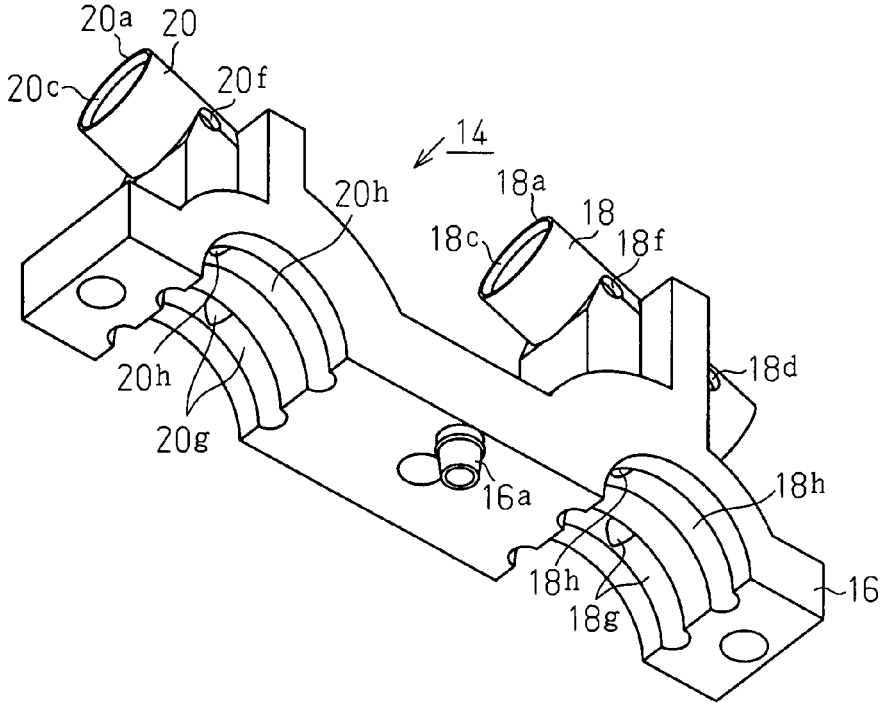
FIG. 9 is a perspective view showing the cam cap assembly of FIG. 6 from below.
Figure 10:
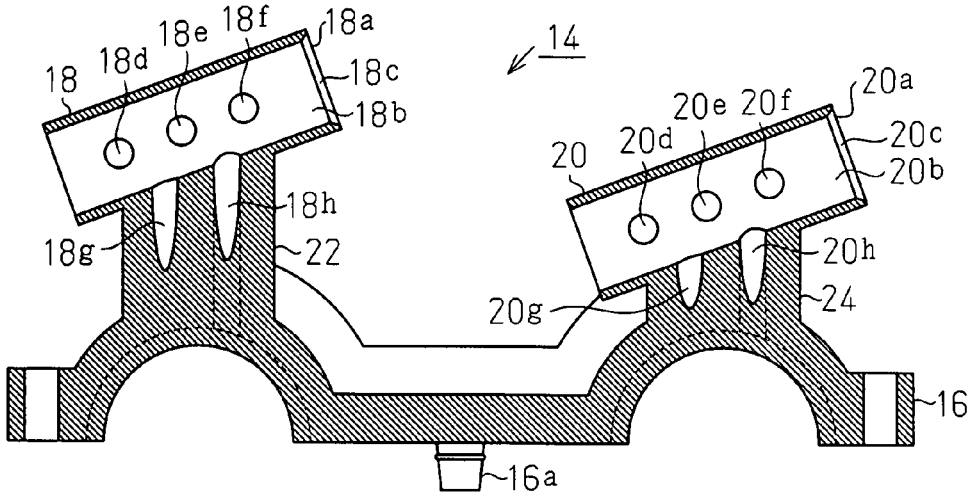
FIG. 10 is a longitudinal cross-sectional view showing the cam cap assembly of FIG. 6 from behind.

FIGS. 6 to 11 show the cam cap assembly 14. FIGS. 6 and 8 are perspective views taken from viewpoints that are separated from each other by 180° C. about a vertical axis.

The cam cap assembly 14 includes a base 16, two sleeves 18 and 20 serving as attachment portions, and connection portions 22 and 24 for respectively connecting the sleeves 18 and 20 to the base 16. The base 16 is formed by integrating a cam cap for the intake camshaft 8 and a cam cap for the exhaust camshaft 10. In other words, the base 16 functions as the cam cap for both the intake camshaft 8 and the exhaust camshaft 10.

The sleeves 18 and 20 are cylindrical, and the sleeves 18 and 20 include attachment inlets 18*a* and 20*a* facing diagonally upward directions. The sleeve 18 has an internal space defining an attachment socket 18*b* formed in correspondence with the outer shape of a spool valve 2*a* of the OCV 2. The sleeve 20 has an internal space defining an attachment socket 20*b* formed in correspondence with the outer shape of a spool valve 4*a* of the OCV 4. The attachment inlet 18*a* includes a tapered surface 18*c* to facilitate insertion of the OCV 2 into the attachment socket 18*b*, and the attachment inlet 20*a* includes a tapered surface 20*c* to facilitate the insertion of the OCV 4 into the attachment socket 20*b*.

The cam cap assembly 14 includes five first oil passages 18*d*, 18*e*, 18*f*, 18*g*, and 18*h* extending from the sleeve 18 and five oil passages 20*d*, 20*e*, 20*f*, 20*g*, and 20*h* extending from the sleeve 20. The first oil passages 18*d* to 18*h* respectively correspond to five ports P1, P2, P3, P4, and P5 of the OCV 2 and are in communication with the attachment socket 18*b*. The second oil passages 20*d* to 20*h* respectively correspond to five ports P1, P2, P3, P4, and P5 of the OCV 4 and are in communication with the attachment socket 20*b*.

One of the first oil passages 18*d* to 18*h*, namely, a retarding oil passage 18*g*, supplies oil pressure to a retarding oil pressure chamber of a first variable valve mechanism (not shown) arranged at the distal end of the intake camshaft 8 through a retarding oil passage 8*a* extending through the intake camshaft 8 along the axis of the intake camshaft 8. This controls the intake camshaft 8 towards the retarding side. One of the second oil passages 20*d* to 20*h*, namely, a retarding oil passage 20*g*, supplies oil pressure to a retarding oil pressure chamber of a second variable valve mechanism (not shown) arranged at the distal end of the exhaust camshaft 10 through a retarding oil passage 10*a* extending through the exhaust camshaft 10 along the axis of the exhaust camshaft 10. This controls the exhaust camshaft 8 towards the retarding side.

Another one of the first oil passages 18*d* to 18*h*, namely, an advancing oil passage 18*h*, supplies oil pressure to an advancing oil pressure chamber of the first variable valve mechanism through an advancing oil passage 8*b* extending through the intake camshaft 8 along the axis of the intake camshaft 8. This controls the intake camshaft 8 towards the advancing side. Another one of the second oil passages 20*d* to 20*h*, namely, an advancing oil passage 20*h*, supplies oil pressure to an advancing oil pressure chamber of the second variable valve mechanism through an advancing oil passage 10*b* extending through the exhaust camshaft 10 along the axis of the exhaust camshaft 10. This controls the exhaust camshaft 10 towards the advancing side.

A further one of the first oil passages 18*d* to 18*h*, namely, a supply oil passage 18*e*, which is supplied with oil pressure from a hydraulic oil supply passage 6*b* formed in the cylinder head 6, supplies the oil pressure to the retarding oil passage 18*g* and the advancing oil passage 18*h* via the OCV 2. A further one of the second oil passages 20*d* to 20*h*, namely, a supply oil passage 20*e*, which is supplied with oil pressure from the hydraulic oil supply passage 6*b*, supplies the oil pressure to the retarding oil passage 20*g* and the advancing oil passage 20*h* via the OCV 4. The supply oil passages 18*e* and 20*e* are joined with each other at the middle part of the base 16 and connected to the supply oil passage 6*b* by a connector 16*a*. The supply oil passages 18*e* and 20*e* may be pipes extending from the sleeves 18 and 20 instead of being arranged in the cam cap assembly 14. In this case, the hydraulic oil pressure is supplied from the supply oil passage 6*b* to the supply oil passages 18*e* and 20*e* by connecting the distal ends of the pipes directly to the supply oil passage 6*b* or to the connector 16*a* of the base 16.

The two remaining first oil passages 18*d* to 18*h*, namely, discharge oil passages 18*d* and 18*f*, function to discharge hydraulic oil discharged from the advancing oil passage 18*h* when hydraulic oil is supplied to the retarding oil passage 18*g* and to discharge hydraulic oil discharged from the retarding oil passage 18*g* when hydraulic oil is supplied to the advancing oil passage 18*h* into the inside of the head cover 12. The discharge oil passages 18*d* and 18*f* extend through the circumferential wall of the sleeve 18. In other words, the discharge oil passages 18*d* and 18*f* have openings in the inner circumferential surface and the outer circumferential surface of the sleeve 18. The two remaining second oil passages 20*d* to 20*h*, namely, the discharge oil passages 20*d* and 20*f*, function to discharge hydraulic oil discharged from the advancing oil passage 20*h* when hydraulic oil is supplied to the retarding oil passage 20*g* and to discharge hydraulic oil discharged from the retarding oil passage 20*g* when hydraulic oil is supplied to the advancing oil passage 20*h* into the inside of the head cover 12. The discharge oil passages 20*d* and 20*f* extend through the circumferential wall of the sleeve 20. In other words, the discharge oil passages 20*d* and 20*f* have openings in the inner circumferential surface and the outer circumferential surface of the sleeve 20.

The cam cap assembly 14, which includes the base 16, the sleeves 18 and 20, and the connection portions 22 and 24, is integrally molded from the same material as the cylinder head 6, that is, from aluminum alloy in the present embodiment.

Figure 11:
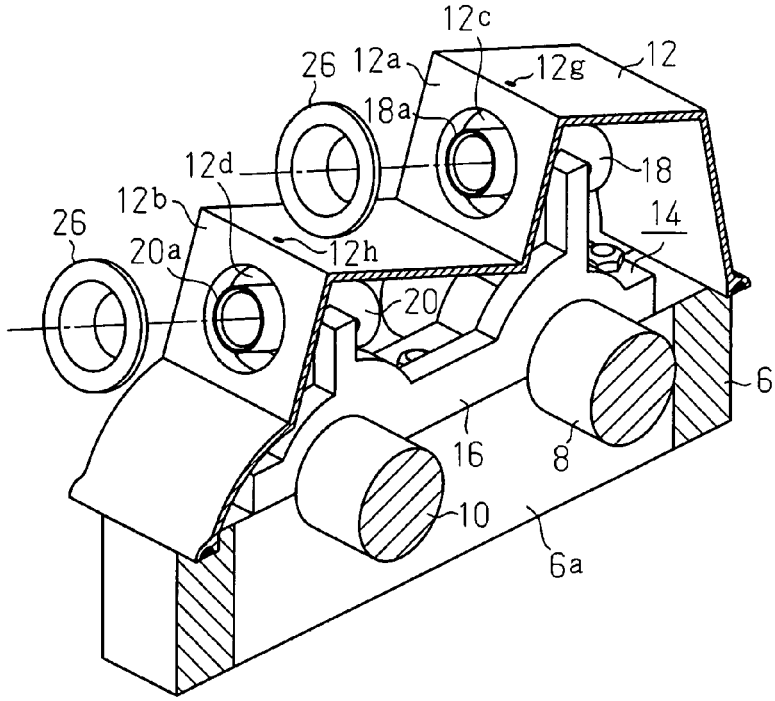
FIG. 11 is an exploded perspective view showing the OCV mounting structure of FIG. 1.
Figure 12:
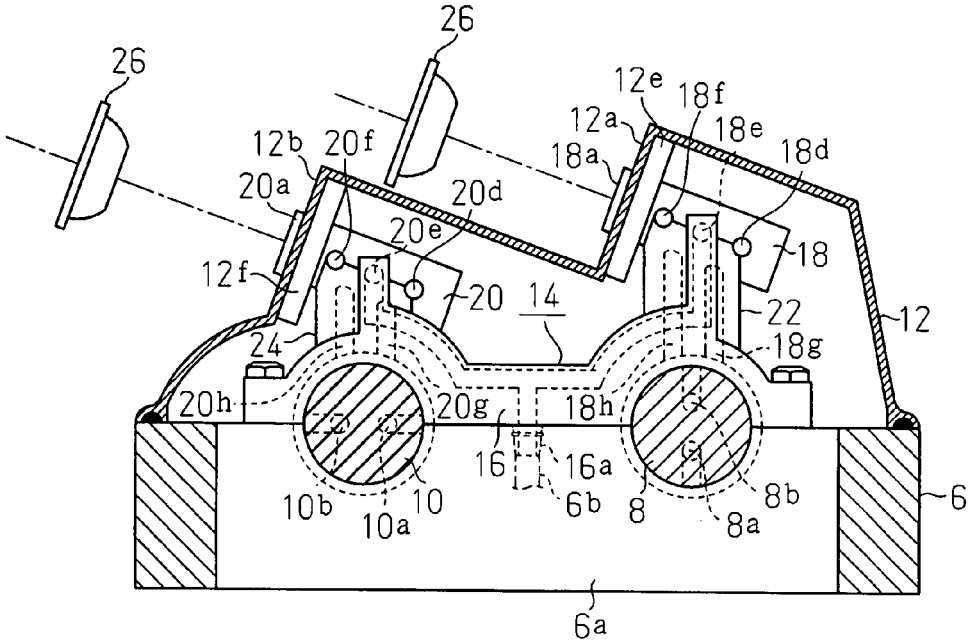
FIG. 12 is an exploded front view showing the OCV mounting structure of FIG. 1.
Figure 13A:
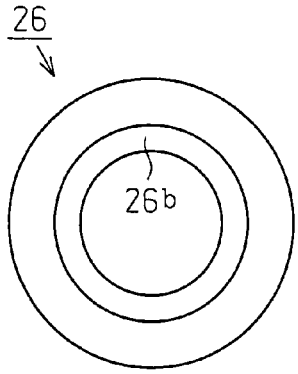
FIG. 13(A) is a front view showing a ring-shaped gasket in the OCV mounting structure of FIG. 1.
Figure 13C:
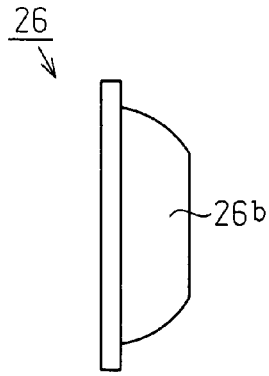
FIG. 13(C) is a right view showing the gasket.
Figure 13D:
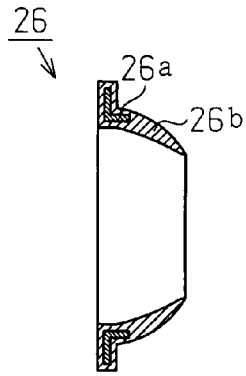
FIG. 13(D) is a right longitudinal cross-sectional view showing the gasket.
Figure 13B:
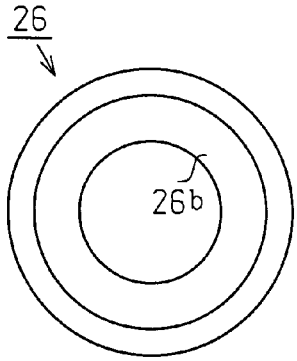
FIG. 13(B) is a rear view showing the gasket.
Figure 13E:
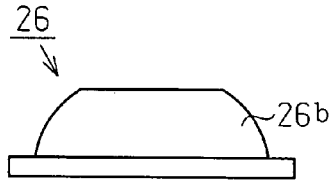
FIG. 13(E) is a plan view showing the gasket.
Figure 13F:
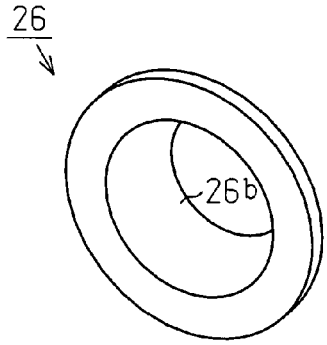
FIG. 13(F) is a perspective view showing the gasket.

The head cover 12 has attachment surfaces 12*a* and 12*b* respectively facing the attachment inlets 18*a* and 20*a* of the sleeves 18 and 20 when attaching the head cover 12 to the cylinder head 6, as shown in FIGS. 11 and 12. An opening 12*c* having a diameter larger than the outer diameter of the sleeve 18 is formed on the attachment surface 12*a*, and an opening 12*d* having a diameter larger than the outer diameter of the sleeve 20 is formed on the attachment surface 12*b*. The attachment inlet 18*a* of the sleeve 18 projects out of the head cover 12 from the opening 12*c*, and the attachment inlet 20*a* of the sleeve 20 projects out of the head cover 12 from the opening 12*d*. A ring-shaped reinforcement rib 12*e* is arranged around the circumference of the opening 12*c*, and a ring-shaped reinforcement rib 12*f* is arranged around the circumference of the opening 12*d*.

The attachment inlet 18*a* of the sleeve 18 does not necessarily have to project out of the head cover 12 from the opening 12*c* and may be located in the opening 12*c* or inward from the opening 12*c* in the head cover 12. In this case, the OCV 2 is inserted into the attachment socket 18*b* so that the part of the OCV 2 inserted into the attachment socket 18*b* (electromagnetic solenoid 2*d* in the present embodiment) projects out of the head cover 12 through the opening 12*c*. In the same manner, the attachment inlet 20*a* of the sleeve 20 does not necessarily have to project out of the head cover 12 from the opening 12*d* and may be located in the opening 12*d* or inward from the opening 12*d*. In this case, the OCV 4 is inserted into the attachment socket 20*b* so that the part of the OCV 4 inserted into the attachment socket 20*b* (electromagnetic solenoid 4*d* in the present embodiment) projects out of the head cover 12 through the opening 12*d*.

A gap between the circumferential surface of the sleeve 18 and the circumference of the opening 12*c* and a gap between the circumferential surface of the sleeve 20 and the circumference of the opening 12*d* are each oil-sealed by a ring-shaped gasket 26, serving as a sealing member, so that hydraulic oil does not leak out of the head cover 12 from the gaps.

Figure 14:
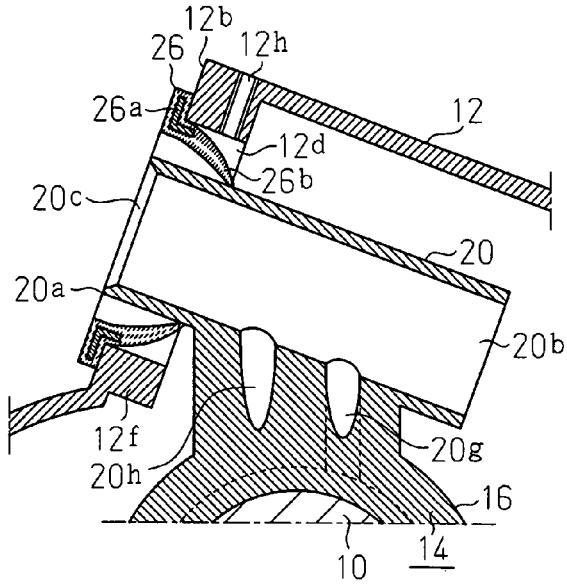
FIG. 14 is a partial longitudinal cross-sectional view showing the OCV mounting structure of FIG. 1 prior to attachment of the OCV.

Referring to FIGS. 13(A) to (F), each gasket 26 is formed by a metal ring 26*a* having an L-shaped cross-section, and a lip 26*b*, which is made of a rubber elastic body and covers the metal ring 26*a*. The lip 26*b* includes a cylindrical portion and a flange portion arranged at the basal end of the cylindrical portion. The diameter of the cylindrical portion becomes smaller as the flange portion becomes farther. Referring to FIG. 14, when the gaskets 26 are fitted to the openings 12*c* and 12*d* of the head cover 12, the basal end of the cylindrical portion of the lip 26*b* of each gasket 26 is pressed against the circumference of the opening 12*c* or 12*d* and the distal end of the cylindrical portion of the lip 26*b* of the gasket 26 comes into contact with the entire circumferential surface of the sleeve 18 or 20. This oil-seals the gaps between the circumferential surfaces of the sleeves 18 and 20 and the circumferences of the opening 12*c* and 12*d*. Even if the dimensional accuracy of the head cover 12 is low or even if the head cover 12 deforms when attaching the head cover 12 to the cylinder head 6 such that dimensional differences are produced at the gaps between the circumferential surfaces of the sleeves 18 and 20 and the circumference of the openings 12*c* and 12*d*, the lips 26*b*, which are made of a rubber elastic body, flex and deform so as to compensate for the dimensional differences. This oil-seals the gaps in a satisfactory manner. Similarly, even if dimensional differences are produced at the gaps between the circumferential surfaces of the sleeves 18 and 20 and the circumferences of the openings 12*c* and 12*d* due to deformation of the head cover 12 caused by inner pressure of the head cover 12 or thermal expansion differences between the head cover 12, which is made of a resin, and the cylinder head 6, which is non-resin, the lips 26*b* deform so as to compensate for the dimensional differences. This oil-seals the gaps in a satisfactory manner.

Figure 15:
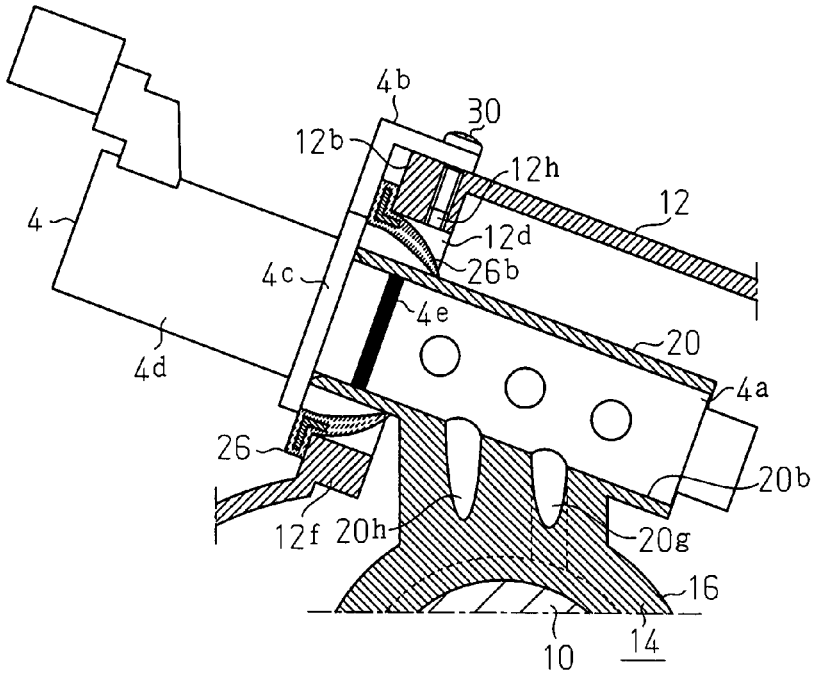
FIG. 15 is a partial longitudinal cross-sectional view showing the OCV mounting structure subsequent to attachment of the OCV.

When attaching the OCV 4 to the sleeve 20, the spool valve 4*a* of the OCV 4 is inserted into the attachment socket 20*b* of the sleeve 20, as shown in FIG. 15. A stay 4*b* arranged on the OCV 4 to keep the OCV 4 fastened is fixed to the outer surface of the head cover 12 by fastening a screw 30 to a threaded hole 12*h* formed in the head cover 12. Similarly, when installing the OCV 2 to the sleeve 18, the spool valve 2*a* of the OCV 2 is inserted into the attachment socket 18*b* of the sleeve 18. A stay 2*b* arranged on the OCV 2 to keep the OCV 2 fastened is fixed to the outer surface of the head cover 12 by fastening a screw 30 to a threaded hole 12*g* formed in the head cover 12.

Attachment of the OCV 4 to the sleeve 20 in such a manner firmly holds the flange portion of the gasket 26 between the attachment surface 12*b* of the head cover 12 and the stay 4*b* and ring 4*c* of the OCV 4. Similarly, attachment of the OCV 2 to the sleeve 18 firmly holds the flange portion of the gasket 26 between the attachment surface 12*a* of the head cover 12 and the stay 2*b* and ring 2*c* of the OCV 2. The gasket 26 is thus strongly adhered to the head cover 12. The ring 2*c* is arranged between the spool valve 2*a* and the electromagnetic solenoid 2*d* of the OCV 2, and the stay 2*b* extends from the ring 2*c*. The ring 4*c* is arranged between the spool valve 4*a* and the electromagnetic solenoid 4*d* of the OCV 4, and the stay 4*b* extends from the ring 4*c*.

The structure in the vicinity of the sleeve 18 at the side of the intake camshaft 8 is not shown in FIGS. 14 and 15. However, the oil seal structure for the sleeve 18 is the same as the oil seal structure for the sleeve 20 at the side of the exhaust camshaft 10 shown in FIGS. 14 and 15.

Figure 3:
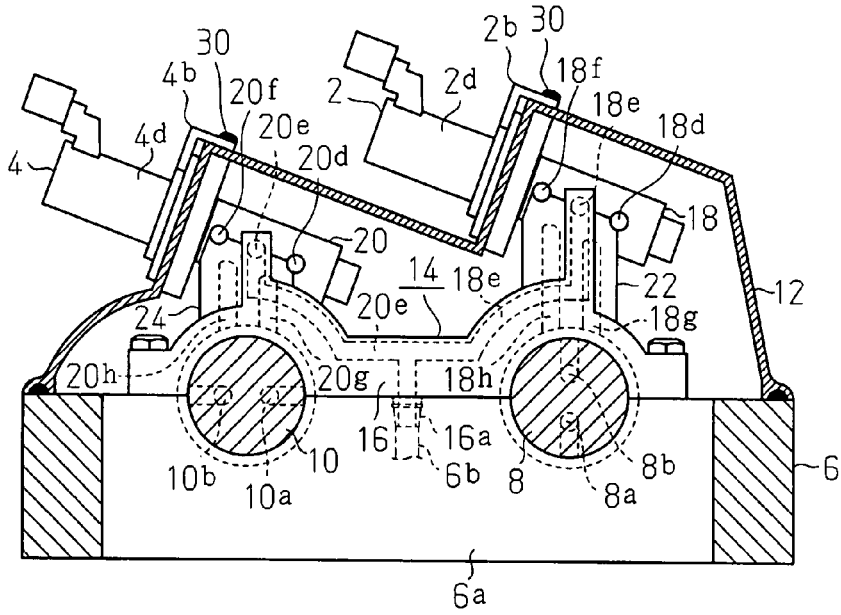
FIG. 3 is a front view showing the OCV mounting structure of FIG. 1.
Figure 4:
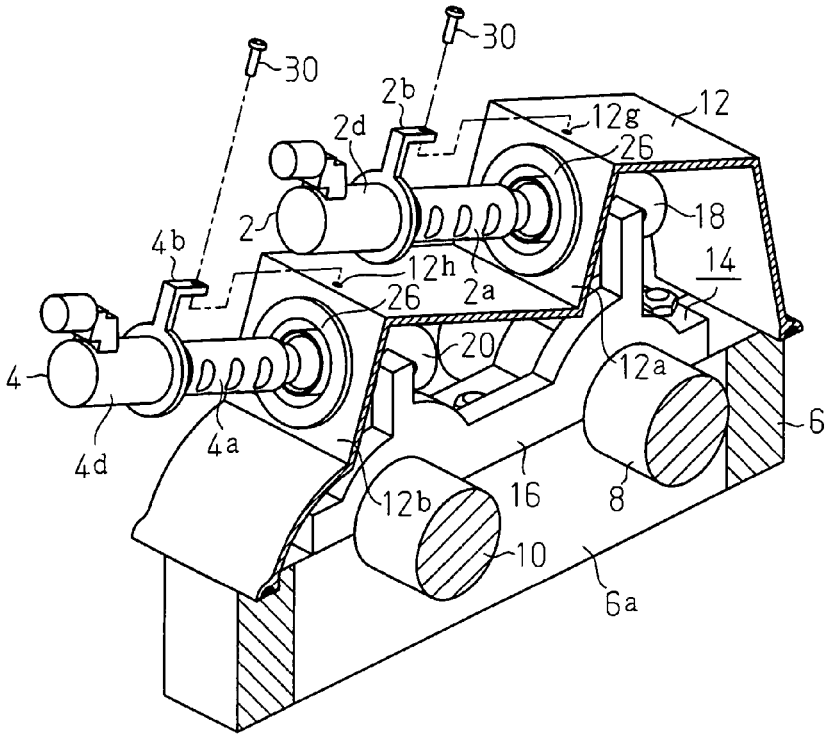
FIG. 4 is an exploded perspective view showing the OCV mounting structure of FIG. 1.
Figure 5:
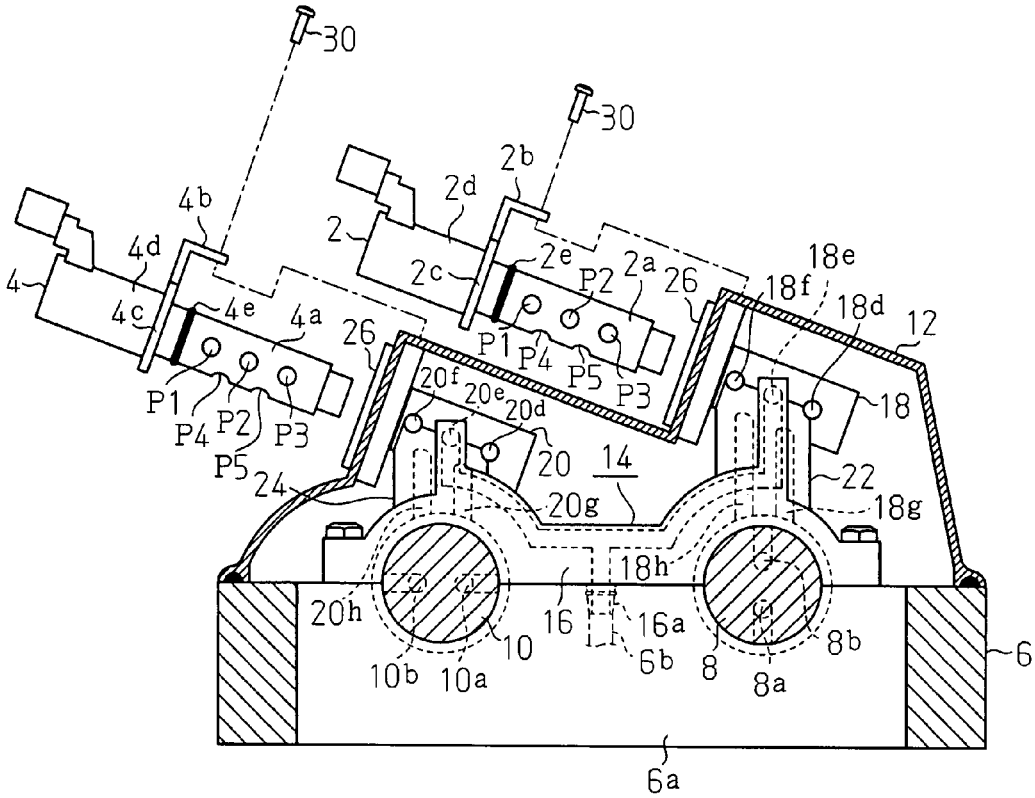
FIG. 5 is an exploded front view showing the OCV mounting structure of FIG. 1.
Figure 16:
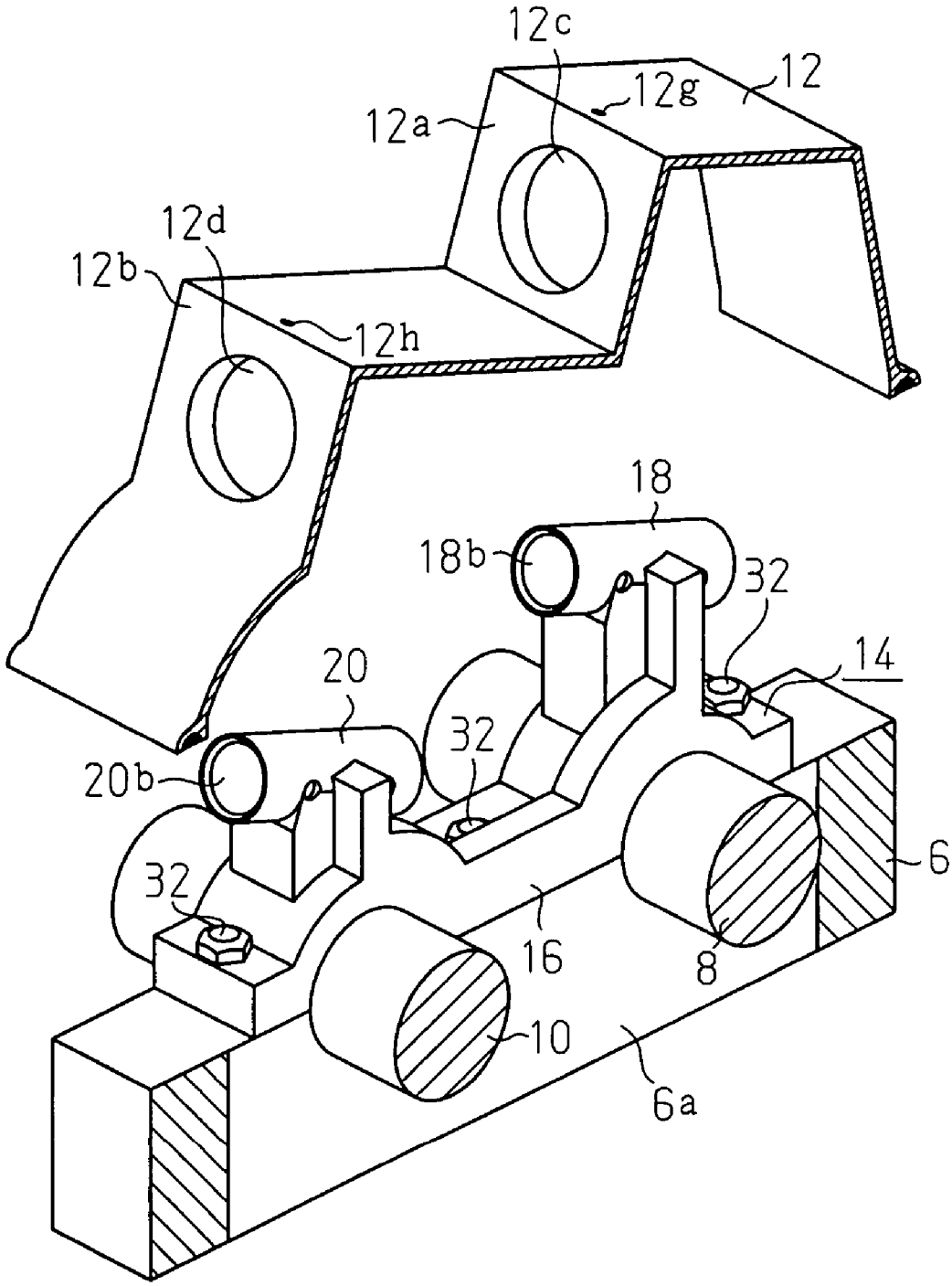
FIG. 16 is an exploded perspective view showing the OCV mounting structure of FIG. 1.

When assembling the mounting structures for the OCVs 2 and 4 shown in FIGS. 1 to 3, the two camshafts 8 and 10 are first arranged on the cam journal 6*a*, as shown in FIG. 16. Next, the cam cap assembly 14 is fastened to the cam journal 6*a* by bolts 32. The cam cap assembly 14 rotatably supports the camshafts 8 and 10. The head cover 12 is then fastened to the cylinder head 6 by bolts so as to cover the cam cap assembly 14. The gaskets 26 are then fitted to the openings 12*c* and 12*d* of the head cover 12, as shown in FIG. 14. Thereafter, the spool valve 2*a* of the OCV 2 is inserted into the attachment socket 18*b* of the sleeve 18 from the attachment inlet 18*a*, and the spool valve 4*a* of the OCV 4 is inserted into the attachment socket 20*b* of the sleeve 20 from the attachment inlet 20*a*, as shown in FIGS. 4 and 5.

Signal lines extending from an electronic control unit (not shown) are connected to the electromagnetic solenoids 2*d* and 4*d* of the OCVs 2 and 4 that are exposed from the head cover 12. The OCVs 2 and 4 drive the variable valve mechanisms with the hydraulic oil supplied to the supply oil passages 18*e* and 20*e* from the hydraulic oil supply passage 6*b* of the cylinder head 6. Consequently, the valve timing of the intake valve and the exhaust valve is adjusted in accordance with the operation state of the engine.

If the OCVs 2 and 4 must be replaced due to reasons such as malfunctioning or the like, the OCVs 2 and 4 are withdrawn from the attachment sockets 18*b* and 20*b* after removing the screws 30. New OCVs are then inserted into and attached to the attachment sockets 18*b* and 20*b*, and the stays of the new OCVs are fixed to the outer surface of the head cover 12 with the screws 30. This completes the replacement of the OCVs.

The first embodiment has the advantages described below.

(1) The OCVs 2 and 4 are connected to the camshafts 8 and 10, which serve as internal mechanisms of the internal combustion engine arranged in the vicinity of the cylinder head 6 in a state covered by the head cover 12, by the cam cap assembly 14. The OCVs 2 and 4 are partially exposed (electromagnetic solenoid 2*d* and 4*d* in the present embodiment) from the head cover 12 through the openings 12*c* and 12*d*. The stays 2*b* and 4*b*, which keep the OCVs 2 and 4 fastened, extend across the outer surface of the head cover 12 from the OCVs 2 and 4, which are inserted into the attachment sockets 18*b* and 20*b*, and are fixed by the screws 30. Thus, the stays 2*b* and 4*b* are detached from the outer side of the head cover 12 by loosening the screws 30 without removing the head cover 12 from the cylinder head 6, and the OCVs 2 and 4 are withdrawn from the attachment sockets 18*b* and 20*b* of the sleeves 18 and 20. This facilitates the removal and replacement of the OCVs 2 and 4.

(2) The sleeves 18 and 20 are formed integrally with the base 16. Thus, the sleeves 18 and 20 are positioned on the cylinder head 6 by fixing the base 16 to the cam journal 6*a*. Furthermore, the sleeves 18 and 20 are integrally molded with the base 16 by way of the connection portions 22 and 24. Thus, the oil passages 18*g*, 18*h*, 20*g*, and 20*h* extending from the sleeves 18 and 20 to the base 16 are seamless and provide a high oil-seal.

(3) The base 16 is formed by integrating the cam cap for the intake camshaft 8 and the cam cap for the exhaust camshaft 10. This improves the positioning accuracy and the positioning stability of the sleeves 18 and 20 with respect to the cylinder head 6.

(4) The OCV 2 is attached to the sleeve 18 so that the distal end of the spool valve 2*a* is lower than the basal end of the spool valve 2*a*, and the OCV 4 is attached to the sleeve 20 so that the distal end of the spool valve 4*a* is lower than the basal end of the spool valve 4*a*. Therefore, even if hydraulic oil leaks out from between the OCVs 2 and 4 and the sleeves 18 and 20, the leaking hydraulic oil does not move towards the basal ends of the spool valves 2*a* and 4*a* and moves towards the distal end of the spool valve 2*a* and 4*a* to fall into the inside of the head cover 12. Furthermore, even if the hydraulic oil moves towards the basal ends of the spool valves 2*a* and 4*a*, the hydraulic oil is prevented from leaking out of the head cover 12 by O-rings 2*e* and 4*e* arranged on the basal ends of the spool valve 2*a* and 4*a*. Therefore, the hydraulic oil that leaks out from between the OCVs 2 and 4 and the sleeves 18 and 20 falls onto the cylinder head 6. This facilitates the recovery of oil from the cylinder head 6.

The direction for inserting the OCV 2 into the sleeve 18 and the direction for inserting the OCV 4 into the sleeve 20 are the same. This facilitates the attachment of the OCVs 2 and 4.

(5) The gaskets 26 fitted to the openings 12*c* and 12*d* of the head cover 12 oil-seal the gaps between the circumferential surfaces of the sleeves 18 and 20 and the circumferences of the openings 12*c* and 12*d* as the cylindrical portion of the lips 26*b* contacts the circumferential surface of the sleeves 18 and 20. Thus, even if dimensional differences are produced at the gaps between the circumferential surfaces of the sleeves 18 and 20 and the circumferences of the openings 12*c* and 12*d* due to dimensional errors or the like of the head cover 12, as described above, the lips 26*b* deform so as to compensate for the dimensional differences. This oil-seals the gaps in a satisfactory manner. As a result, the sleeves 18 and 20 are positioned with respect to the cylinder head 6 in a satisfactory manner without being influenced by the dimensional errors or the like of the head cover 12. This ensures high oil seal and enables the oil pressure to be controlled with high accuracy.

(6) The gaskets 26 are just pushed into and fitted into the openings 12*c* and 12*d* from the outer side of the head cover 12 and easily attached to the openings 12*c* and 12*d*. Further, the gaskets 26 may also be pulled out from the openings 12*c* and 12*d* and easily removed from the openings 12*c* and 12*d* when the OCVs 2 and 4 are not attached to the sleeves 18 and 20. Therefore, the gaskets 26 may also be easily replaced without having to remove the head cover 12.

The stays 2*b* and 4*b* extend across the OCVs 2 and 4 and the outer surface of the head cover 12. Thus, the stays 2*b* and 4*b* function to prevent not only the OCVs 2 and 4 but also the gaskets 26 from falling off. Thus, the OCV mounting structure facilitates replacement of the OCVs 2 and 4 and the gaskets 26 with a simpler structure.

In the first embodiment, the rings 2*c* and 4*c* of the OCVs 2 and 4 also function to prevent the gasket 26 from falling off with the stays 2*b* and 4*b*.

A second embodiment of the present invention will now be described.

Figure 17:
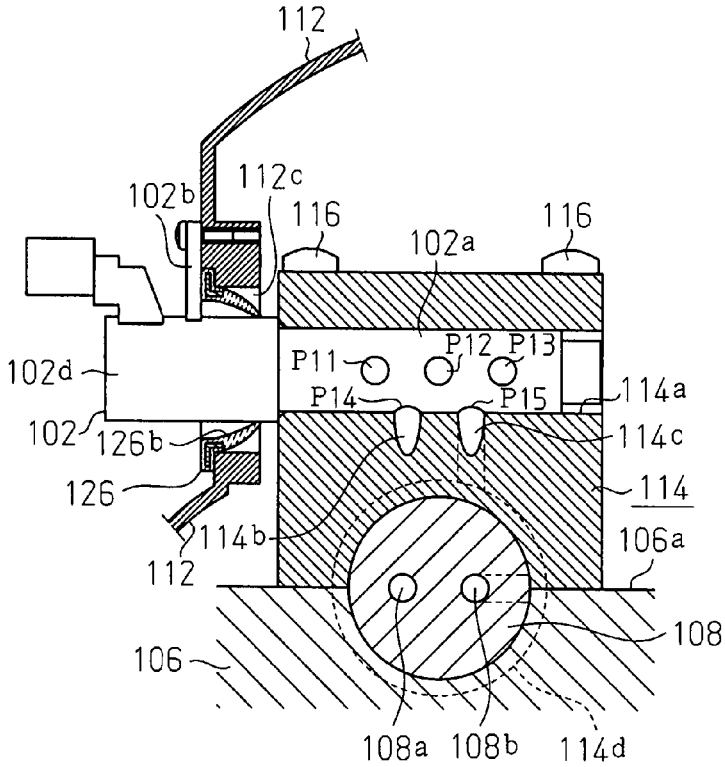
FIG. 17 is a longitudinal cross-sectional view showing an OCV mounting structure according to a second embodiment of the present invention.

As shown in FIG. 17, a cam cap assembly is arranged for each camshaft in the second embodiment. A cam cap assembly 114 for an intake camshaft 108 will now be described. A cam cap assembly for an exhaust camshaft has the same structure.

The cam cap assembly 114 has a generally box-like shape as a whole. The cam cap assembly 114 has a lower part defining a base that functions as a cam cap. An attachment socket 114*a* having a circular cross-section is formed on the upper part of the cam cap assembly 114. The cam cap assembly 114 has an upper part functioning as the attachment portion. The attachment socket 114*a* extends in a direction orthogonal to the axis of the intake camshaft 108. A bolt hole, which is not in communication with the attachment socket 114*a*, is formed in the cam cap assembly 114. A bolt 116 is inserted from the bolt hole to a cam journal 106*a*. The bolt 116 is fastened to a cylinder head 106 so that the base of the cam cap assembly 114 and the cam journal 106*a* rotatably supports the intake camshaft 108.

Five oil passages respectively corresponding to ports P11, P12, P13, P14, and P15 of the OCV 102 attached to the attachment socket 114*a* are formed in the cam cap assembly 114. Among the five oil passages, discharge oil passages respectively corresponding to the discharge ports P11 and P13 and an supply oil passage corresponding to the supply port P12 are not shown in FIG. 17 since they are located above the cross-sectional plane of FIG. 17. The discharge oil passages opens in the surface of the cam cap assembly 114, and the hydraulic oil discharged from the discharge ports P11 and P13 is discharged into the inside of the head cover 112 through the discharge oil passages. The supply oil passage extends through the cam cap assembly 114 to the cylinder head 106 or through a pipe extending to the cylinder head 106 for connection to a hydraulic oil supply passage of the cylinder head 106. This introduces hydraulic oil into the supply port P12 from the hydraulic oil supply passage of the cylinder head 106.

Among the five oil passages, the supply and discharge oil passages 114*b* and 114*c* respectively corresponding to the supply and discharge ports P14 and P15 extend through the cam cap assembly 114 to positions facing the intake camshaft 108. The supply and discharge oil passage 114*b* is connected to an advancing oil pressure chamber of the variable valve mechanism by an advancing oil passage 108*a* formed in the intake camshaft 108, and the supply and discharge oil passage 114*c* is connected to a retarding oil pressure chamber of the variable valve mechanism by a retarding oil passage 108*b* formed in the intake camshaft 108.

The head cover 112 has an opening 112*c* that faces the opening of the attachment socket 114*a* when the head cover 112 is attached to the cylinder head 106. A ring-shaped gasket 126 having different dimensions but the same shape as the gasket 26 of FIG. 13 is fitted to the opening 112*c*. A spool valve 102*a* of the OCV 102 is inserted into the attachment socket 114*a* through the gasket 126.

When the spool valve 102*a* of the OCV 102 is inserted into the attachment socket 114*a*, a lip 126*b* (cylindrical portion) of the gasket 126 contacts the peripheral surface of the electromagnetic solenoid 102*d*. This oil-seals a gap between the circumference of the opening 112*c* of the head cover 112 and the circumferential surface of the OCV 102. The OCV 102 is fixed to the head cover 112 by a screw that fastens a stay 102*b*, which extends from the peripheral surface of the electromagnetic solenoid 102*d*, to the outer surface of the head cover 112. The stay 102*b* contacts the gasket 126 from the outer side and prevents the gasket 126 from falling out of the opening 112*c* of the head cover 112.

The second embodiment described above has the advantage described below in addition to advantages (1), (2), (5) and (6) of the first embodiment.

The lip 126*b* of the gasket 126 contacts the peripheral surface of the electromagnetic solenoid 102*d* when the spool valve 102*a* of the OCV 102 is inserted into the attachment socket 114*a*. Thus, the hydraulic oil does not leak out of the head cover 112 wherever oil leakage occurs in the attachment socket 114*a* or even if an O-ring is not used for the spool valve 102*a* of the OCV 102. Hydraulic oil that leaks out falls onto the cylinder head 106. This facilitates the recovery of oil from the cylinder head 106.

A third embodiment of the present invention will now be described.

Figure 18:
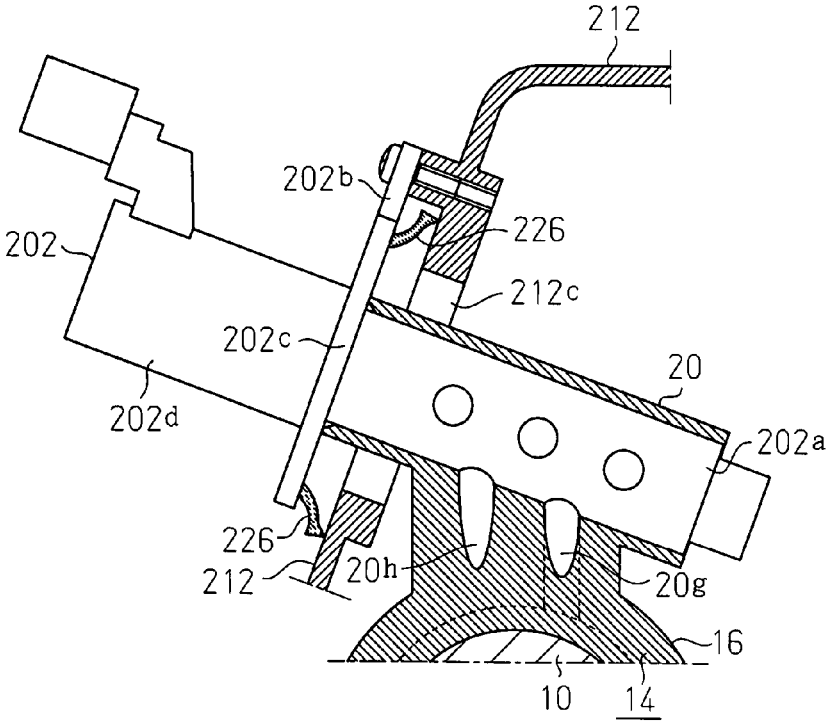
FIG. 18 is a longitudinal cross-sectional view showing an OCV mounting structure according to a third embodiment of the present invention.

In the third embodiment, referring to FIG. 18, a ring-shaped flange 202*c* is arranged on the periphery of an OCV 202 (in the present embodiment, between a spool valve 202*a* and an electromagnetic solenoid 202*d*), and a ring-shaped oil seal 226, which serves as a seal member and is made of a rubber elastic body, is bonded to the flange 202*c* by an adhesive. The cam cap assembly 14 is the same as the first embodiment and is thus denoted with the same reference numeral and will not be described. The structure in the vicinity of the sleeve at the side of the intake camshaft is not shown in FIG. 18. However, the oil seal structure for the sleeve is the same as the oil seal structure for the sleeve 20 at the side of the exhaust camshaft 10 shown in FIG. 18.

After mounting the cam cap assembly 14 and the head cover 212 on the cylinder head, the OCV 202 is attached to the sleeve 20. As a result, the distal end of the oil seal 226 arranged on the flange 202*c* contacts the head cover 212 at the circumference of the opening 212*c*. The OCV 202 is fixed to the sleeve 20 in a state in which the oil seal 226 is pressed against the circumference of the opening 212*c* by fastening a stay 202*b*, which extends in the radial direction from the ring-shaped flange 202*c*, to the outer surface of the head cover 212 with bolts.

The third embodiment has the advantages described below.

(1) The oil seal 226 arranged on the OCV 202 contacts the outer surface of the head cover 212 at the circumference of the opening 212*c*. Thus, an O-ring does not need to be arranged at the spool valve 202*a* of the OCV 202. Advantages (1) to (4) of the first embodiment are obtained with a structure simpler than the mounting structure of the first embodiment.

(2) The oil seal 226 attached around the OCV 202 contacts the outer surface of the head cover 212 at the circumference of the opening 212*c*. This oil-seals a gap between the outer circumferential surface of the sleeve 20 and the circumference of the opening 212*c*. Thus, even if dimensional differences are produced at the gap between the outer circumferential surface of the sleeve 20 and the circumference of the opening 212*c* due to dimensional errors or the like of the head cover 212, which is made of resin, as mentioned in the description of the first embodiment, the oil seal 226 deforms so as to compensate for the dimensional differences. This oil-seals the gap in a satisfactory manner. As a result, the sleeve 20 is accurately positioned relative to the cylinder head without being affected by dimensional differences or the like of the head cover 212. This ensures high oil seal and enables oil pressure to be controlled with high accuracy.

(3) The oil seal 226 is arranged on the OCV 202. Thus, by attaching the OCV 202 to the sleeve 20, the oil seal 226 is easily attached to the head cover 212. Further, the oil seal 226 may easily be removed from the head cover 212 by removing the OCV 202 from the sleeve 20 without dismounting the head cover 212. The oil seal 226 is easily replaced by removing the OCV 202 from the sleeve 20.

A fourth embodiment of the present invention will now be described with reference to FIGS. 9 to 21.

In the fourth embodiment, a device other than an OCV, that is, a cam angle sensor 252, is used as a functional device for an internal combustion engine.

Figure 19:
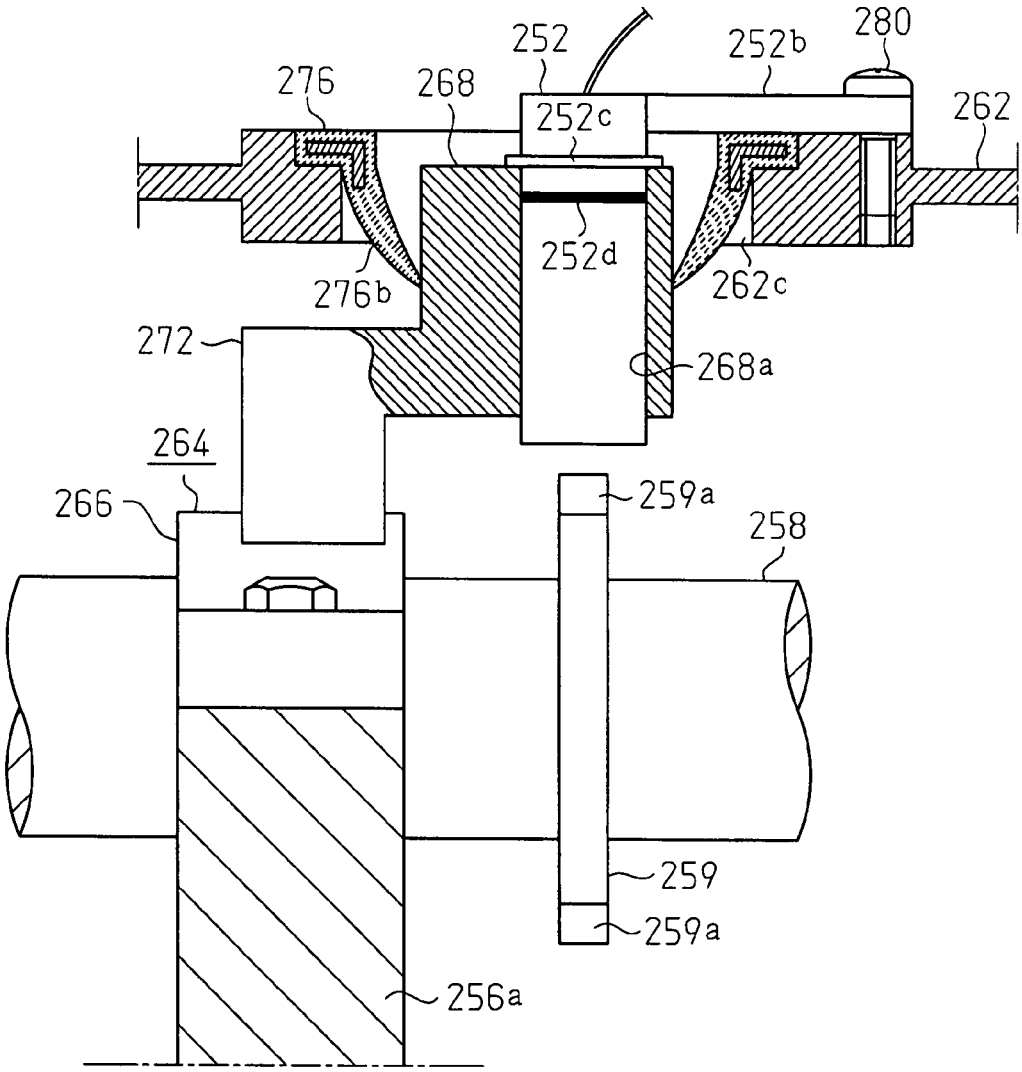
FIG. 19 is a longitudinal cross-sectional view showing a cam angle sensor mounting structure according to a fourth embodiment of the present invention.
Figure 20:
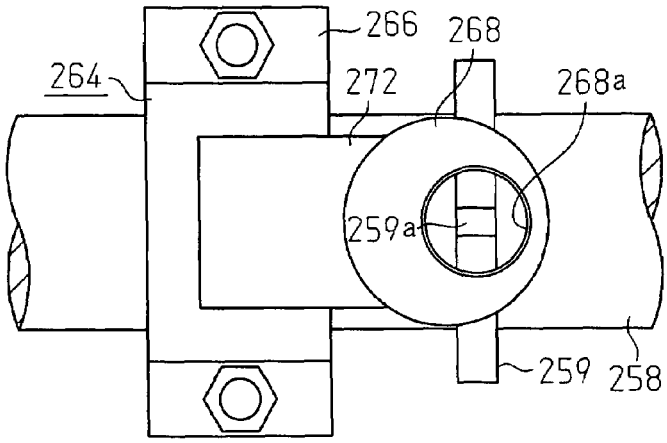
FIG. 20 is a plan view showing the arrangement of the cam cap assembly in the cam angle sensor mounting structure of FIG. 19.
Figure 21:
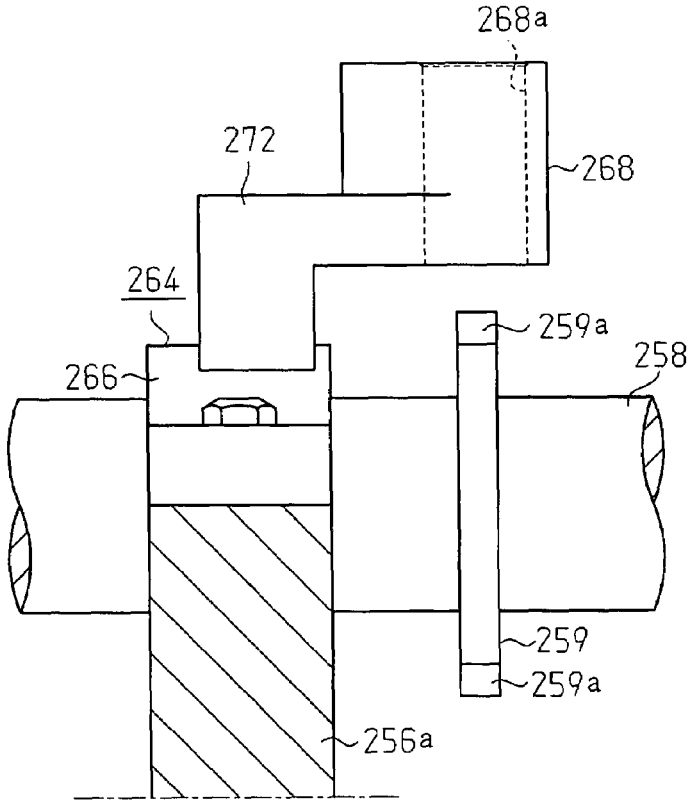
FIG. 21 is a front view showing the arrangement of the cam cap assembly of FIG. 20.

As shown in FIGS. 19 to 21, a cam cap assembly 264 includes a base 266 functioning as a cam cap of the intake camshaft 258, a sleeve 268, and a connection portion 272 for connecting the base 266 and the sleeve 268. The base 266, the sleeve 268, and the connection portion 272 are formed by the same metal material as the cylinder head.

A rotor 259 fixed to the intake camshaft 258 to rotate integrally with the intake camshaft 258 is arranged in the vicinity of a cam journal 256*a*. The connection portion 272 is designed so that an attachment socket 268*a* formed in the sleeve 268 is located above the rotor 259.

As shown in FIG. 19, a head cover 262 is arranged so that the sleeve 268 of the cam cap assembly 264 is located in an opening 262*c* of the head cover 262. In this state, a ring-shaped gasket 276 is fitted into the opening 262*c*. This oil-seals a gap between the circumference of the opening 262*c* and the outer circumferential surface of the sleeve 268. The structure of the gasket 276 is the same as the gasket 26 of FIG. 13.

The cam angle sensor 252 is attached to the attachment socket 268*a*. A stay 252*b* extends from the basal end of the cam angle sensor 252 that is exposed from the attachment socket 268*a*. The stay 252*b* is fastened to the outer surface of the head cover 262 by a screw 280. A flange 252*c* is formed on the periphery of the cam angle sensor 252, and the cam angle sensor 252 is positioned with respect to the rotor 259 by contacting the flange 252*c* to the upper surface of the sleeve 268. An O-ring 252*d* is received in a groove formed in the portion of the cam angle sensor 252 closer to the distal end from the flange 252*c*. The O-ring 252*d* oil-seals a gap between the attachment socket 268*a* and the cam angle sensor 252.

The cam angle sensor 252, which is arranged to face the rotor 259, detects the rotational movement of teeth 259*a* arranged on the rotor 259 and outputs a cam angle signal.

The fourth embodiment has the advantages described below.

(1) The cam angle sensor 252 is arranged near and facing toward the rotor 259, which serves as an internal mechanism of the internal combustion engine covered by the head cover 262, by means of the cam cap assembly 264. The cam angle sensor 252 has a part (basal end) exposed from the head cover 262 through the opening 262*c*. The stay 252*b* for keeping the cam angle sensor 252 fastened is arranged to extend across the outer surface of the head cover 262 from the cam angle sensor 252, which is inserted into the attachment socket 268*a*, and fixed to the outer surface with the screw 280. Thus, the stay 252*b* may be detached and the cam angle sensor 252 may be withdrawn from the attachment socket 268*a* of the sleeve 268 by loosening the screw 280 from the outer side of the head cover 262 without dismounting the head cover 262 from the cylinder head. This facilitates the removal and replacement of the cam angle sensor 252.

(2) The sleeve 268 is formed integrally with the base 266. Thus, the sleeve 268 is positioned with respect to the cylinder head by fixing the base 266 to the cam journal 256*a*.

The base 266 directly contacts the intake camshaft 258 and supports the intake camshaft 258 with the cam journal 256*a*. Thus, the base 266 is accurately positioned relative to the rotor 259 attached to the intake camshaft 258. This improves the detection accuracy of the cam angle sensor 252.

(3) The gasket 276, which is fitted into the opening 262*c* of the head cover 262, oil-seals a gap between the circumference of the opening 262*c* and the circumferential surface of the sleeve 268 by having the cylindrical portion of the lip 276*b* contact the circumferential surface of the sleeve 268. Thus, as mentioned above, even if dimensional differences are produced at the gap between the circumference of the opening 262*c* and the circumferential surface of the sleeve 268 due to dimensional errors or the like of the head cover 262, which is made of resin, the lip 276*b* deforms so as to compensate for the dimensional differences. This oil-seals the gap in a satisfactory manner. As a result, the sleeve 268 is accurately positioned with respect to the cylinder head without being affected by dimensional errors or the like of the head cover 262. This ensures the positioning accuracy of the cam angle sensor 252 and improves the cam angle detection accuracy.

(4) The gasket 276 is easily attached to the opening 262*c* just by pushing and fitting the gasket 276 into the opening 262*c* from the outer side of the head cover 262. Further, the gasket 276 may easily be detached from the opening 262*c* just by pulled out the gasket 276 from the opening 262*c*. Therefore, the gasket 276 is easily replaced without detaching the head cover 262.

The stay 252*b* functions to preventing the cam angle sensor 252 and the gasket 276 from falling out of since the stay 252*b* extend across the cam angle sensor 252 and the outer surface of the head cover 262. Thus, the cam angle sensor mounting structure in which the replacement of both the cam angle sensor 252 and the gasket 276 is facilitated is realized with a simpler structure.

The first to the fourth embodiments may be modified as described below.

The base of the cam cap assembly for attaching the OCV or the cam angle sensor to the cylinder head functions as a cam cap in the first to the fourth embodiments but does not necessarily have to function as a cam cap. That is, the base may function to only fix the attachment portion of the OCV or the cam angle sensor to the cylinder head.

The rings 2*c* and 4*c* and the stays 2*b* and 4*b* come into direct contact with the gasket 26 in the first embodiment, as shown in FIG. 1. However, only the stays 2*b* and 4*b* may be in contact with the gasket 26 or only the rings 2*c* and 4*c* may be in contact with the gasket 26.

Figure 22:
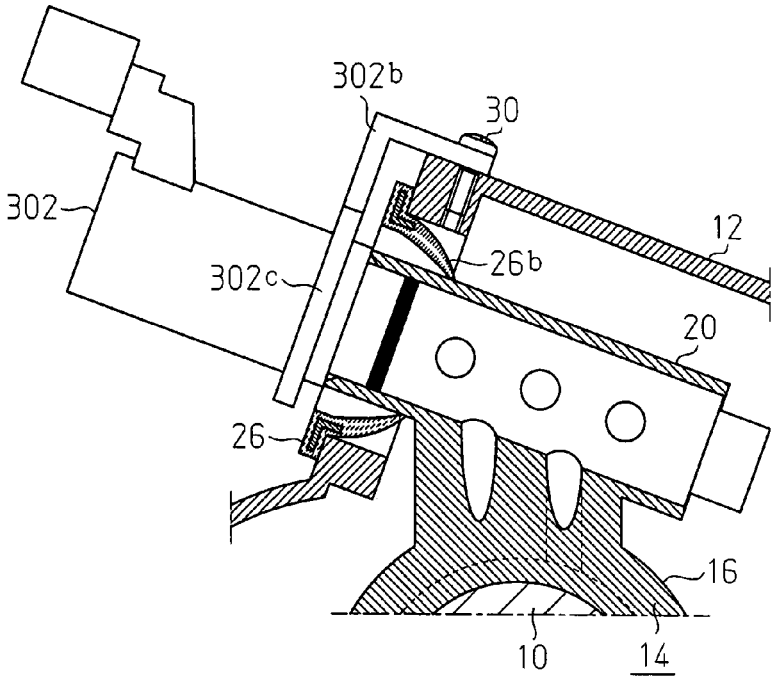
FIG. 22 is a longitudinal cross-sectional view showing an OCV mounting structure according to an other embodiment of the present invention.

The stay or part of the OCV comes into direct contact with the gasket in the first, second and fourth embodiments. However, as shown in FIG. 22, the stay 302*b* or one part 302*c* of the OCV 302 (or cam angle sensor) may be arranged in near and out of contact from the ring-shaped gasket 26. In this case, the stay 302*b* or the part 302*c* of the OCV 302 (or cam angle sensor) contacts the gasket 26 when the gasket 26 is about to fall out of the head cover 12. This prevents the gasket 26 from falling out.

Figure 23:
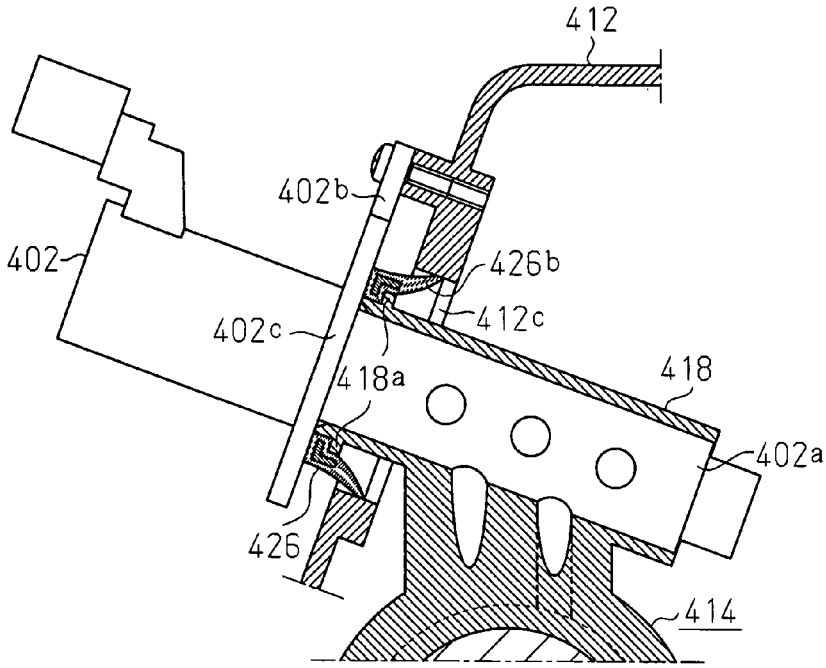
FIG. 23 is a longitudinal cross-sectional view showing an OCV mounting structure according to an other embodiment of the present invention.

The lip of the ring-shaped gasket fitted into the opening of the head cover is in contact with the periphery of the sleeve in the first and the fourth embodiments. Instead, as shown in FIG. 23, a ring-shaped gasket 426 may be attached to the periphery of a sleeve 418, and the distal end of a lip 426*b* of the gasket 426 may come into contact with the circumference of the opening 412*c*. A projection 418*a* is formed on the periphery of the sleeve 418 so as to hold the gasket 426 between the projection 418*a* and one part 402*c* of the OCV 402 (or cam angle sensor). In this state, the OCV 402 (or cam angle sensor) is fastened by a bolt to the outer surface of the head cover 412 by means of a stay 402*b*.

In this case as well, a gap between the head cover 412 and the sleeve 418 is oil sealed. Furthermore, the ring-shaped gasket 426 is compressed between the part 402*c* of the OCV 402 (or cam angle sensor) and the projection 418*a*. Thus, a gap between the sleeve 418 and the OCV 402 (or cam angle sensor) is oil-sealed at the same time.

The attachment of the cam angle sensor 252 in the fourth embodiment is similar to the attachment of the OCVs 2 and 4 in the first embodiment. However, the cam angle sensor 252 may be attached in the same manner as the OCV 202 of the third embodiment.

In the fourth embodiment, instead of or in addition to the cam angle sensor for an intake camshaft, a cam angle sensor for an exhaust camshaft may be in the same manner as the cam angle sensor for an intake camshaft. In this case, the positioning accuracy and the positioning stability of the sleeve with respect to the cylinder head are improved by integrating the base of the cam cap assembly as in the first embodiment.

The invention claimed is:

1. A mounting structure for a functional device for an internal combustion engine, wherein the functional device is connected to or faces toward an internal mechanism of the internal combustion engine arranged in the vicinity of a cylinder head in a state covered by a head cover, the functional device being partially exposed from the head cover through an opening in the head cover, the mounting structure comprising:

an attachment portion for attachment of the functional device, the functional device when attached to the attachment portion being detachable from the attachment portion through the opening;

a base integrated with the attachment portion, the base being fixed to the cylinder head in order to position the attachment portion relative to the cylinder head;

a seal member for oil-sealing a gap between the circumference of the opening and a circumferential surface of the attachment portion or a gap between the circumference of the opening and a circumferential surface of the functional device; and a stay extending across the functional device and an outer surface of the head cover to keep the functional device fastened to the attachment portion.

2. The mounting structure according to claim 1, wherein the functional device is an oil control valve for performing hydraulic oil pressure supply and discharge control for a variable valve mechanism of the internal combustion engine, the internal mechanism being a camshaft including an oil passage extending to the variable valve mechanism.

3. The mounting structure according to claim 2, wherein the attachment portion is a cylindrical sleeve including an attachment socket, the base is a cam cap, and the sleeve and the cam cap are integrally molded.

4. The mounting structure according to claim 3, wherein the cam cap is formed by integrating a cam cap for an intake camshaft and a cam cap for an exhaust camshaft.

5. The mounting structure according to claim 2, wherein an end of the oil control valve at the inner side of the head cover is lower than an end of the oil control valve at the outer side of the head cover.

6. The mounting structure according to claim 1, wherein the internal combustion engine includes a camshaft and the functional device is a cam angle sensor for detecting a rotation phase of the camshaft, and the internal mechanism is a rotor arranged on the camshaft facing toward the cam angle sensor.

7. The mounting structure according to claim 1, wherein the seal member includes a cylindrical portion and is attached to the opening, and the seal member oil-seals the gap by having the cylindrical portion of the seal member contact the outer circumference of the attachment portion or the outer circumference of the internal combustion engine functional device.

8. The mounting structure according to claim 7, wherein the seal member is attached to the opening in a manner detachable from the outside of the head cover.

9. The mounting structure according to claim 1, wherein the seal member has a cylindrical portion and is attached to the attachment portion or the internal combustion engine functional device, and the seal member oil-seals the gap by having the cylindrical portion of the seal member contact an inner circumference of the opening.

10. The mounting structure according to claim 9, wherein the seal member is attached to the attachment portion or the internal combustion engine functional device in a manner detachable from the outside of the head cover.

11. The mounting structure according to claim 8, wherein the stay extends across the functional device and the outer surface of the head cover in a state arranged in the vicinity of the seal member or in a state contacting the seal member to prevent the seal member from falling off the head cover.

12. The mounting structure according to claim 8, wherein the functional device when attached to the attachment portion has a part arranged in the vicinity of the seal member or contacting the seal member to prevent the seal member from falling out of the head cover.

13. The mounting structure according to claim 1, wherein the head cover is made of resin.

14. The mounting structure according to claim 3, wherein an end of the oil control valve at the inner side of the head cover is lower than an end of the oil control valve at the outer side of the head cover.

15. The mounting structure according to claim 4, wherein an end of the oil control valve at the inner side of the head cover is lower than an end of the oil control valve at the outer side of the head cover.

16. The mounting structure according to claim 2, wherein the seal member includes a cylindrical portion and is attached to the opening, and the seal member oil-seals the gap by having the cylindrical portion of the seal member contact the outer circumference of the attachment portion or the outer circumference of the internal combustion engine functional device.

17. The mounting structure according to claim 3, wherein the seal member includes a cylindrical portion and is attached to the opening, and the seal member oil-seals the gap by having the cylindrical portion of the seal member contact the outer circumference of the attachment portion or the outer circumference of the internal combustion engine functional device.

18. The mounting structure according to claim 4, wherein the seal member includes a cylindrical portion and is attached to the opening, and the seal member oil-seals the gap by having the cylindrical portion of the seal member contact the outer circumference of the attachment portion or the outer circumference of the internal combustion engine functional device.

19. The mounting structure according to claim 5, wherein the seal member includes a cylindrical portion and is attached to the opening, and the seal member oil-seals the gap by having the cylindrical portion of the seal member contact the outer circumference of the attachment portion or the outer circumference of the internal combustion engine functional device.

20. The mounting structure according to claim 6, wherein the seal member includes a cylindrical portion and is attached to the opening, and the seal member oil-seals the gap by having the cylindrical portion of the seal member contact the outer circumference of the attachment portion or the outer circumference of the internal combustion engine functional device.

* * * * *